United States Patent [19]

Diener

[11] 3,945,502

[45] Mar. 23, 1976

[54] CABLE LIFTING DEVICE

[76] Inventor: Robert W. Diener, General Delivery, Teton Village, Wyo. 83025

[22] Filed: July 18, 1974

[21] Appl. No.: 489,479

[52] U.S. Cl. ..... 212/8 B; 212/144

[51] Int. Cl.[2] ..... B66C 23/00

[58] Field of Search ..... 212/8 R, 8 A, 8 B, 9, 35 R, 212/35 HC, 58 R, 59 R, 59 A, 144

[56] References Cited

UNITED STATES PATENTS

| | | | |
|---|---|---|---|
| 614,518 | 11/1898 | Terry | 212/58 R |
| 1,374,224 | 4/1921 | Patterson | 212/8 R |
| 2,598,517 | 5/1952 | Drott | 212/8 R |
| 2,665,012 | 1/1954 | McLain et al. | 212/8 R |
| 2,831,592 | 4/1958 | Syracuse | 212/8 R |
| 3,064,824 | 11/1962 | Beatty | 212/8 R |
| 3,472,395 | 10/1969 | Hubbard et al. | 212/8 R |

*Primary Examiner*—Robert J. Spar
*Assistant Examiner*—Lawrence J. Oresky
*Attorney, Agent, or Firm*—Trask & Britt

[57] ABSTRACT

A device for lifting cables to an overhead structure is disclosed. The device includes an A-frame jib pivotally supported through a pair of yoked clevises on an elongated shaft fixed to a base clamping member. The uppermost section of the jib includes a head assembly having a stationary shaft to which a pulley is rotatably mounted and a bifurcated purchase is pivotally mounted. A hoist is hung from the purchase for lifting cables to the overhead structure. An adjustable guy line or boom hoist cable is secured at one end of the head assembly and at the other end to the overhead structure. Any adjustment made to the boom hoist cable will be reflected by a corresponding pivotal movement of the jib about its yoked clevis.

7 Claims, 7 Drawing Figures

CABLE LIFTING DEVICE

BACKGROUND OF THE INVENTION

1. Field

This invention is directed generally to a hoisting device and particularly to a device for hoisting cables overhead.

2. State of the Art

Prior art devices such as those shown in U.S. Pat. Nos. 898,010; 2,130,464; 2,553,779 and 2,951,596 are representative of the devices and techniques heretofore employed in placing cables on an overhead structure. In each instance, the devices employed are specifically designed for lifting cables; however, they are generally incapable of positioning the lifted cable at a particular point of placement on the overhead structure.

Further, the devices shown in the above patents have limited capabilities of redistributing the forces encountered during the lifting process, particularly when the angle of the jib or boom is altered. As a result, the devices have limited application in raising or lifting heavy loads. In those instances where the devices are designed to handle heavy loads, they are from a structural standpoint, very large and cumbersome and as a result cannot be readily transported and used in areas where vehicular movement is restricted.

To overcome the above shortcomings, it is a primary object of this invention to provide a hoisting device which is portable and which is capable of being used in areas which would normally be inaccessible. Another object of this invention is to provide a hoisting device which is structurally sound and operationally safe. Still another object of this invention is to provide a hoisting device which is capable of lifting up to forty times its own weight. Another object of this invention is to provide a hoisting device which can lift and move cables in both a vertical and a horizontal plane. A final object of this invention is to provide a device capable of transferring lifting forces to the base of the jib over a broad range of angular positions.

SUMMARY OF THE INVENTION

These and other objects of this invention are achieved by the lifting device hereinafter described. The device of this invention comprises broadly a base clamping member adapted for attachment to an overhead structure, a jib pivotally supported to the base clamping member and a head assembly fixed to the top section of the jib. The head assembly is adapted to include a stationary shaft to which a purchase is journaled for pivotal movement. To achieve lifting, a hoist is hung from the head assembly and an adjustable boom hoist cable is secured at one of its ends to the top of the jib and secured at the other end to the overhead structure. The cable to be lifted is attached to the hoist and raised in a vertical plane to an elevation higher than the point of placement. The cable is then moved in a substantially horizontal plane to a point directly above the point of placement by adjustment of the boom hoist cable. The cable is then lowered into position by manipulation of the hoisting mechanism.

More specifically, the lifting device of this invention includes a base member having an elongated shaft and an "A" frame shaped jib pivotally carried on the elongated shaft by means of a pair of yoked clevises fixed to and extending downward from the legs of the jib. A head assembly is attached to the upper end of the jib which includes a stationary shaft to which a pulley is rotatably mounted and a bifurcated purchase is pivotally mounted. An arcuate, overhead, U-shaped member or crown bow is welded at its ends to sleeves circumscribing the ends of the stationary shaft. This member reinforces the jib point, forms a gusset to stiffen the A-frame and provides a handle for maneuvering the jib. To prevent the yoked clevis from slipping off the elongated shaft during use, keeper pins are provided to pass through openings in the end section of the yoked clevis encompassing the elongated shaft and thereby secure the jib to the stationary shaft without interfering with the jib's pivotal movement.

DESCRIPTION OF THE PREFERRED EMBODIMENT

Figures 1, 2:
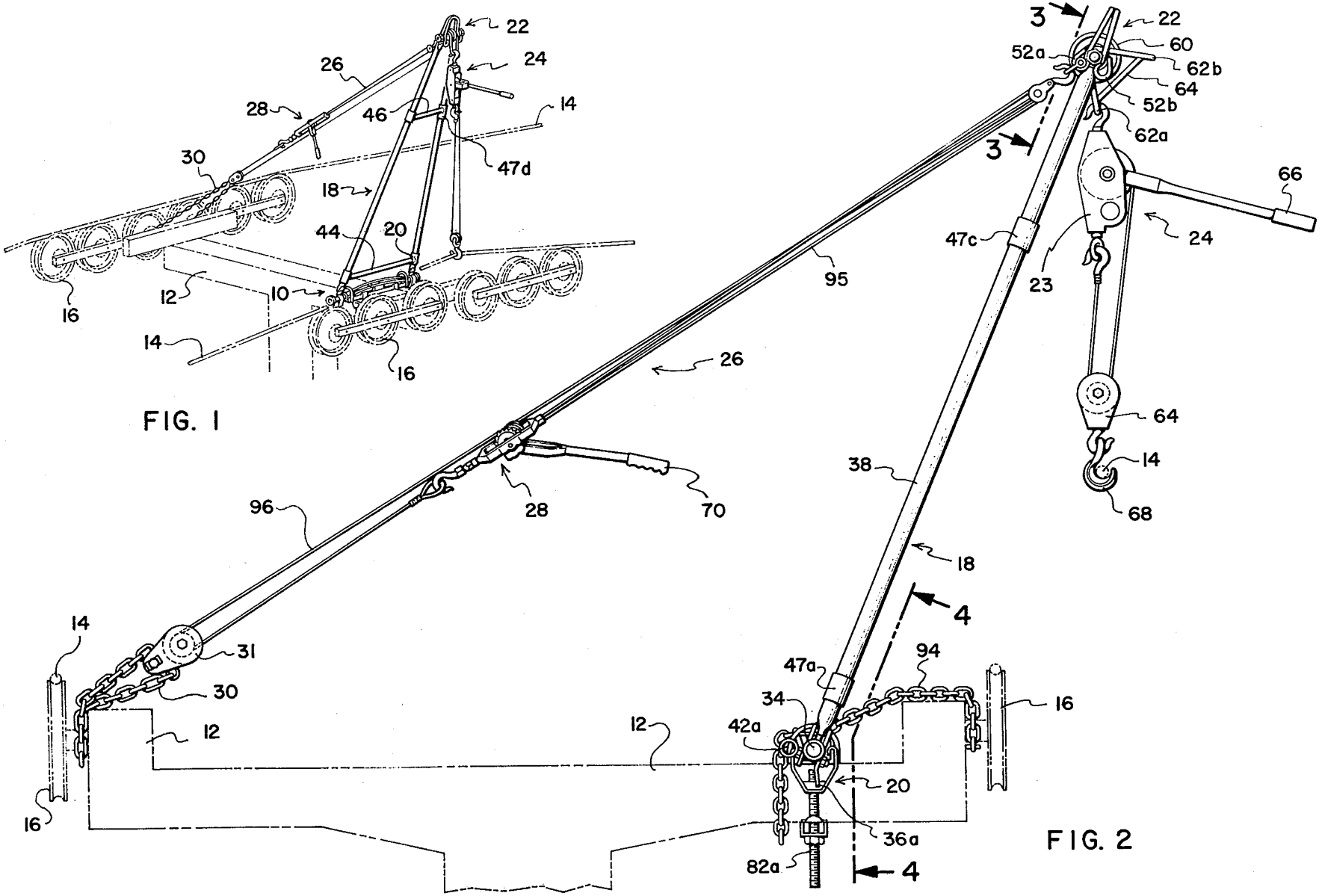
FIG. 1 is a three dimensional view of the cable lifting device of this invention operatively mounted to the top of a ski lift tower.
FIG. 2 is a side elevation of the cable lifting device shown in FIG. 1.

As shown in FIG. 1, the cable lifting device of this invention includes a base clamping member 10 fixed to an overhead structure 12. Although the overhead structure can be used to support any type of line or cable such as telephone or power lines, the tower shown in the drawing is one specifically designed to support an extended overhead cable 14 such as those found on most conventional ski lifts. As shown, the cable is slideably carried on a series of pulleys 16. Chairs in turn are hung from the cable by suitable attachments. The cable and chair lifts are moved by a power source located at or near the base of the ski lift.

A jib 18 is pivotally supported at or near its lower end section 20 to a base clamping member 10. A head assembly 22 is fixed to the top section of the jib. A hoist 24 is hung from the head assembly which, upon manipulation, can be lowered to receive a cable 14 and to vertically lift the cable to an elevation higher than the point of placement which, as shown in the illustration depicted in FIG. 1, is the pulleys 16 rotatably mounted to the overhead structure 12. A boom hoist cable 26 having a ratchet assembly 28 is secured at one of its ends to the head assembly 22 and the other end to an overhead structure by means of a chain 30. The main component parts of the device of this invention, namely, the jib 18, the overhead assembly 22 and the base support member 20, will now be considered in more specific detail.

Jib

Referring now to FIGS. 2–7, inclusive, it can be seen that the jib 18 is pivotally supported on an elongated shaft 34 of the base member 20 by means of a yoked clevis or a forked member **36*a* and 36*b***. The yoked clevises are attached to each flattened or squeezed end 49*a* and 49*b* of legs 38 and 40, respectively, of the A-frame jib 18 through reinforced gussets or connecting members 37*a* and 37*c* and intermediate member 49*b*. A threaded keeper pin 42 is carried in openings 43*a* and 43*b* in each of the yoked clevises 36*a* and 36*b* to prevent the jib from inadvertently slipping out of engagement from the base support member. As indicated above, one end of the pin is threaded and screwed into a fixed nut 41*a* and 41*b* which is mounted to the side of each yoked clevis in alignment with openings 43*a* and 43*b*. A ring 42*a* is attached to each threaded keeper pin to facilitate injection and removal thereof. The legs 38 and 40 of the jib 18 are structurally supported by cross members 44 and 46, respectively. (See FIG. 1.) Vertical structural support of the leg members 38 and 40 is achieved by the use of welded sleeves 47*a*, 47*b*, 47*c* and 47*d* to which the cross members 44 and 46 are welded.

Head Assembly

Figure 3:
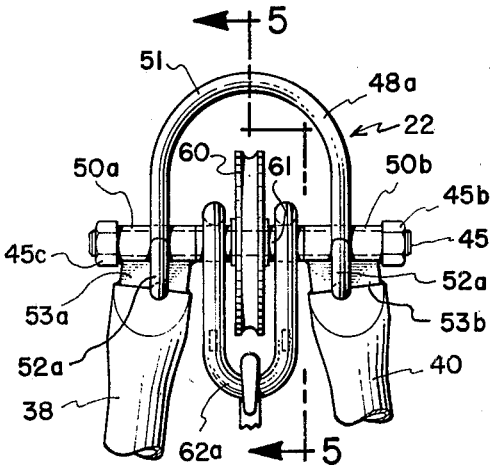
FIG. 3 is a front elevation of the head assembly taken along line 3—3 of FIG. 2.
Figure 5:
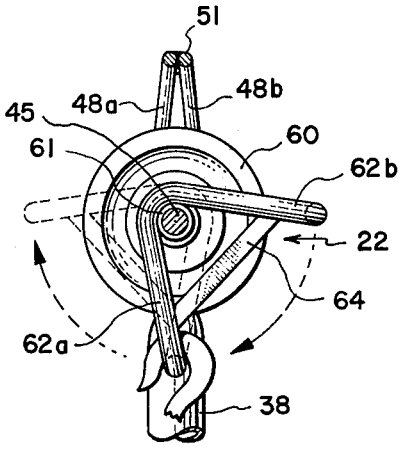
FIG. 5 is a side cross section of the head assembly taken along line 5—5 of FIG. 3.
Figure 4:
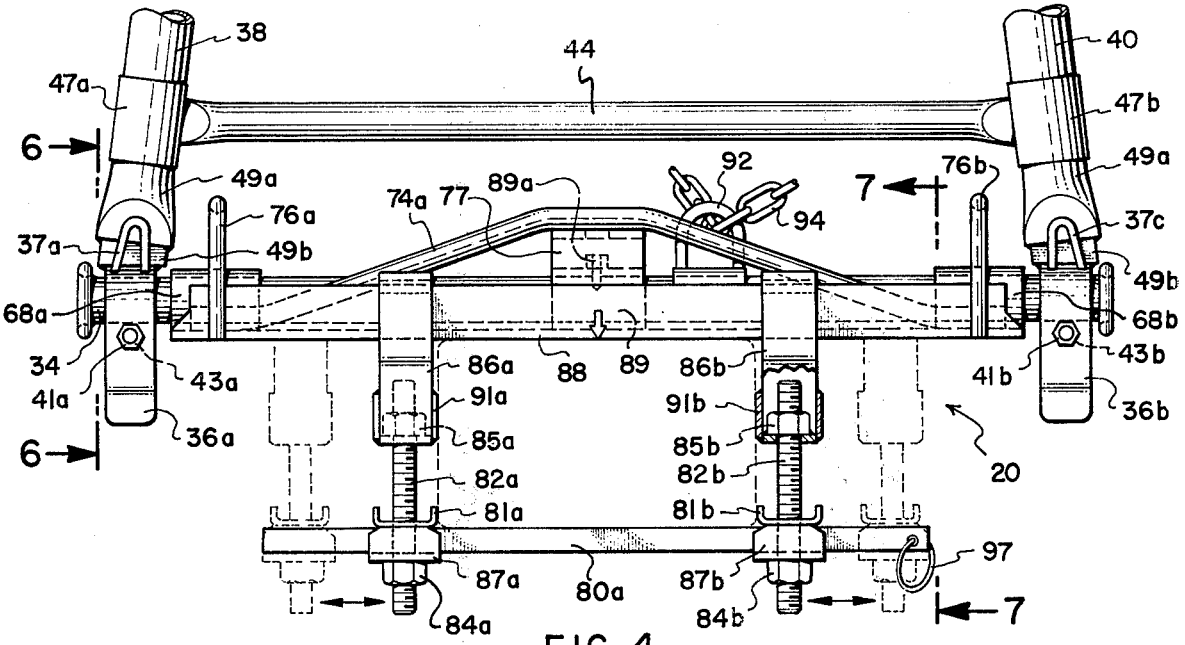
FIG. 4 is a front elevation of the base clamping member taken along line 4—4 of FIG. 2.
Figure 6:
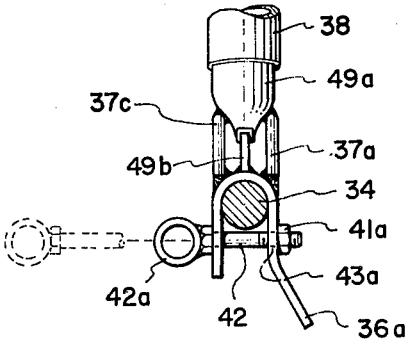
FIG. 6 is a partial side cross section of the base member taken along line 6—6 of FIG. 4.
Figure 7:
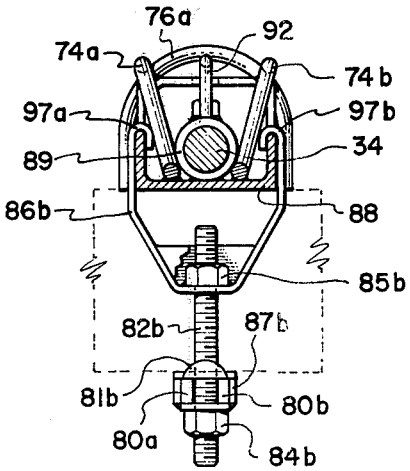
FIG. 7 is a partial side cross section taken along line 7—7 of FIG. 4.

At or near the top of the jib 18 a head assembly 22 shown best in FIGS. 3 and 5, is attached through end sleeves 50*a* and 50*b* circumscribing the end sections of a stationary shaft 45. More specifically, the head assembly includes a threaded stationary shaft 45 which is fixed to the head assembly 22 by means of staked nuts 45*b* and 45*c*. About shaft 45 are two end sleeves 50*a* and 50*b* to which the legs 38 and 40 are welded via connecting plate gussets 53*a* and 53*b*. To add additional structural stability to the head assembly, a U-shaped, arcuate, overhead reinforcing member comprising a pair of steel rods 48*a* and 48*b* curved to form a U-shape are welded near their ends to sleeves 50*a* and 50*b* and welded together at or near their top 51. The ends of the U-shaped members (just below the sleeve weld) are bent inwardly to form a double pair of eyelets 52*a* and 52*b*, respectively. (See FIGS. 2 and 3.)

A pulley or sheave 60 is rotatably and centrally mounted through its hub on the shaft 45. In addition, a bifurcated, dual U-shaped, self equalizing purchase designated by numerals 62*a* and 62*b* is mounted on a sleeve 61 intermediate end sleeves 50*a* and 50*b* for pivotal movement on shaft 45. Preferably, the bifurcated dual purchase will be mounted such that it can form an angle of between about 20° and 80° . The purchase is structurally reinforced by cross member 64. The dimensions of the pulley 60 and the depth of the U-shaped purchase 62*a* and 62*b* is such that the pulley is free to rotate therebetween. In some cases, each loop of the dual purchase 62*a* and 62*b* can be fitted with hoists to complement the lifting process or to transfer loads from one hoist to another.

Attached to and hanging from one of the bifurcated purchase ends 62*a* is a conventional hoist 24 in combination with a conventional hook snatch block 64. (See FIG. 2.) The hoist is operated by a lever 66 which manipulates a conventional gear, pawl and dog (not shown) operatively connected within the casing 23 of the hoist shown. The cable is raised through the hook snatch block 64 by a chocker hook 68 which may be attached thereto. The forces generated by the hoist 24 during vertical lifting are redirected to the legs 38 and 40 of the jib 18 by means of a boom hoist cable 26 which is secured at one end to one of the eyelets 52*a* of the head assembly 22 run through the block 31 and back to the head assembly and secured to the second of the two eyelets 52*a*. The cable passing through block 31 provides a first line 95 and a second or return line 96. The second set of eyelets 52*b* would be used in the same manner as the eyelets 52*a* if a cable was to be lifted on the other side of the tower. Interposed in the boom hoist cable is a ratchet assembly 28 which is manually manipulated through a handle 70. Manipulation of this handle will either tighten or loosen the boom hoist cable 26 as may be desired. The ratchet 28 is of conventional design and includes a gear, pawl and dog (not clearly visible) in cooperative working combination.

Base Support Member

The base support member shown generally by numeral 20 includes a base channel member 88 and an elongated stationary shaft 34. The elongated shaft 34 is carried within the channel member by annular end connecting sleeves 68*a* and 68*b* and an intermediate connecting sleeve 89 fastened to the bottom wall of the channel member 88 as by pins or welds. A pair of overhead support spans 74*a* and 74*b* are welded to the bottom or floor of the channel member 88 adjacent to the annular end sleeves 68*a* and 68*b*. Additional structural support is provided by vertically mounted U-shaped rods 76*a* and 76*b* welded to the outside side walls of channel member 88. The U-shaped rods also provide grasp handles to facilitate handling during installation. A centrally located rectangular shaped support member 77 is welded to the base channel 88 and maintained centered to the intermediate sleeve 89 by a pin or bolt 89*a*. The supporting spans 74*a* and 74*b* are centrally fastened to the upper section of the rectangular support member 77 by welds.

A pair of reinforced connecting members 86*a* and 86*b* are slideably hung by their internally hooked end sections 97*a* and 97*b* from the upright side walls or flanges of the channel member 88. The hooked end sections are bent in a manner such that the reinforced connecting member can be slid along the channel member 88 and thereby allow for lateral adjustment (shown in phantom in FIG. 4) of the clamping assembly. This feature will permit the clamping assembly to be adjusted and thereby accommodate most overhead support structures.

A pair of clamping bars 80*a* and 80*b* are slideably carried within a pair of clamp bar boxes 87*a* and 87*b* which in turn are connected to the lower section of the reinforced connecting members 86*a* and 86*b* by threaded studs 82*a* and 82*b* and nuts 84*a*, 84*b*, 85*a* and 85*b*. The clamp bar boxes 87*a* and 87*b* are covered by bent washers 81*a* and 81*b* welded thereto. Nuts 85*a* and 85*b* are carried within the reinforced connecting members 86*a* and 86*b*, respectively. Turning of the nuts 84*a* and 84*b* will vertically raise or lower the clamping bars 80*a* and 80*b*, as may be required whenever the base member 20 is clamped to the overhead support structure. In operation the threaded studs 82*a* and 82*b* are rotated so that their ends rest against the base of channel member 88 and thereby functions much like a set screw. This procedure tends to stabilize the reinforced connecting members 86*a* and 86*b* with the base channel member 88. To facilitate lateral movement of the clamping bars 80*a* and 80*b*, a cable or ring 97 is looped through openings in the ends of each bar. In addition, a safety chain 94 is provided to pass through an eyelet 92 vertically mounted to the top of the channel member 88 for attachment around the overhead structure 12 when the device is in operation.

Operation

In utilizing the device of this invention, the base clamping member is lifted to an overhead structure and clamped thereto by positioning the reinforced connecting members 86*a* and 86*b* about a beam of the overhead structure and tightening the clamping bar 80*a* and 80*b* by rotation of stud nuts 84*a* and 84*b*. After the clamping member has been securely fastened to the overhead structure, the jib is lifted and connected to the base support member through placement of the yoked clevises 36*a* and 36*b* about the ends of the elongated shaft 34 fastened to the base support member. Keeper pins 42 are then passed through the openings 43*a* in the bottom portion of the yoked clevis and screwed into the mounted nut 41*a* and 41*b*. The jib is positioned at an angle of preferably about 20° to 35° from vertical. The boom hoist cables 22 are then secured at one end to the head assembly of the jib and at the other end by means of a chain 30 and block 31 to the overhead structure.

After the lifting device has been securely positioned on the overhead structure, the sheave or pulley 60 rotatably carried on the head assembly may be utilized to lift the hoist 24 for attachment to the purchase 62 as shown in FIG. 2. The sheave or pulley 60 may also be used to hoist light loads from the ground in conjunction with conventional lifting means, i.e., block and tackle, hoists or power equipment. The same equipment may also be used for lowering loads from the overhead structure to the ground. With the hoist now in position, the handle 66 is manipulated so that the chocker hook 68 is lowered to receive and lift the cable 14 overhead. After the cable has been placed on the chocker hook, the hoist again is manipulated to raise the cable overhead to a point where it is at an elevation slightly above the point of placement. At this point the boom hoist cable 26 is tightened through ratchet 28. During tightening of the boom hoist cable 22, the jib 18 is moved from, for example, a 30° position to possibly a 20° position, thereby moving the lifted cable in a substantially horizontal plane directly above the point of placement. When this has been accomplished, the hoist 24 is then manipulated through handle 66 to lower the cable on the desired point of placement which, as shown in FIG. 1, would be the pulley 16. When the cable has been properly positioned, the chocker hook is removed from the cable and lowered to the ground. If necessary, that is, if a second cable is to be lifted, the action hereinabove described is repeated. If a cable is to be removed from the pulleys 16, the above sequence is, of course, reversed, permitting the cable to be lowered to the ground.

Although the operational procedures just described pertain to the lifting of cables for use on ski lifts, it should be apparent that cables or lines used in power or telephone installations may be lifted or lowered in like fashion. In fact, the device of this invention, with possibly minor modifications, could be used in a variety of other related lifting operations.

While the invention has been described with reference to specific embodiments, it should be understood that changes may be made by one skilled in the art and would not thereby depart from the spirit and scope of this invention which is limited only by the claims appended hereto.

I claim:

1. A portable device for lifting cable to an overhead structure comprising:

a laterally adjustable base clamping member having a means for attached and securing same to an overhead structure, an A-frame jib pivotally mounted on said base clamping member, hoist means for detachable connection to said cables, means detachably connected between said overhead structure and said jib for adjusting the degree of pivot of said jib with respect to said base clamping member, and a head assembly fixed to the upper end of said "A" frame jib, said head assembly including a stationary shaft, a rigid, unitary, bifurcated purchase element with separate loop ends, each arranged to suspend a said hoist means, and connected by a central member which is journaled for pivotal movement on said stationary shaft, a crown bow fixed at or near the ends of said stationary shaft, and a pulley rotatably mounted on said stationary shaft and straddled by said bifurcated purchase element, whereby separate hoist means may be suspended from said separate loop ends.

2. The cable lifting device of claim 1 wherein said bifurcated purchase forms an angle therebetween of between 20° and 80°.

3. The cable lifting device of claim 1 wherein said crown bow has eyelets extending downward from the point of attachment to said shaft.

4. The cable lifting device of claim 1 wherein said purchase includes a hoist hung therefrom.

5. The cable lifting device of claim 4 wherein said head assembly includes an adjustable boom hoist cable connected at one end thereto.

6. A cable lifting device comprising:

an adjustable base clamping member which includes a top elongated shaft, a bottom elongated shaft and a pair of spaced-apart, laterally slidable, vertical connecting members for raising and lowering said bottom elongated shaft, an A-frame jib pivotally supported on said elongated shaft by means of a yoked clevis fixed to and extending downwardly from each leg of said A-frame jib, a head assembly fixed to the upper end of said A-frame jib, said head assembly including a stationary shaft, a rigid, unitary bifurcated purchase element with separate loop ends, each arranged to suspend a said hoist means, and connected by a central member which is journaled for pivotal movement on said stationary shaft, a crown bow fixed at or near the ends of said stationary shaft, and a pulley rotatably mounted on said stationary shaft and straddled by said bifurcated purchase element, and a crown bow fixed at its ends to sleeves encircling the ends of said stationary shaft, whereby separate hoist means may be suspended from said separate loop ends, and removable pins passing through openings in each of said yoked clevis for securing said jib to said elongated shaft without hindering its pivotal movement.

7. The cable lifting device of claim 1 wherein the laterally adjustable base clamping member includes a pair of spaced-apart longitudinal clamping bars and a pair of spaced-apart laterally slidable, vertically adjustable connecting bars for raising and lowering one of said longitudinal clamping bars.

* * * * *